US006904959B2

(12) United States Patent
Pigatto

(10) Patent No.: US 6,904,959 B2
(45) Date of Patent: Jun. 14, 2005

(54) TUBE BUNDLE HEAT EXCHANGER

(75) Inventor: Francesco Pigatto, Concorezzo (IT)

(73) Assignee: Italprotec s.a.s. Di Cotogni Carla E C., Cavenago Brianza (IT)

( * ) Notice: Subject to any disclaimer, the term of this patent is extended or adjusted under 35 U.S.C. 154(b) by 3 days.

(21) Appl. No.: 10/626,211

(22) Filed: Jul. 24, 2003

(65) Prior Publication Data

US 2004/0261974 A1 Dec. 30, 2004

(30) Foreign Application Priority Data

Jun. 24, 2003 (IT) ..... MI2003A1268

(51) Int. Cl.[7] ..... F28F 9/04
(52) U.S. Cl. ..... 165/82; 165/158
(58) Field of Search ..... 165/70, 82, 158, 165/178

(56) References Cited

U.S. PATENT DOCUMENTS 2,196,683 A * 4/1940 Pickstone ..... 165/82
2,762,611 A * 9/1956 Monroe et al. ..... 277/606
3,114,415 A * 12/1963 Wintzer ..... 165/158
3,181,606 A * 5/1965 Belanger ..... 165/158
4,871,014 A * 10/1989 Sulzberger ..... 165/76
6,273,180 B1 * 8/2001 Joshi et al. ..... 165/11.1

FOREIGN PATENT DOCUMENTS

DE 2326365 * 12/1974 ..... 165/158
DE 197 14 423 A1 10/1998
FR 578171 * 9/1924 ..... 165/158

* cited by examiner

*Primary Examiner*—Allen J. Flanigan
(74) *Attorney, Agent, or Firm*—Pearne & Gordon LLP

(57) ABSTRACT

A tube bundle heat exchanger has been carried out, wherein a bearing structure (2) defines at least a primary chamber (3), which is crossed by tubes (4) made of a non-solderable material. A secondary chamber (5) is put in fluid connection with such tubes (4) and is fluid proof with respect to the main chamber (3). Furthermore a tube plate (6), showing the adequate seats (7) for housing the ends of said tubes (4) and a containing plate (9), showing respective holding seats (10) for each tube (4) and for the contemporary housing of sealing means (8), are provided. Finally a third clamping plate (11) is provided, which abuts on the containing plate (9), in order to allow deformation and to prevent blow-by through such sealing means (8).

13 Claims, 3 Drawing Sheets

TUBE BUNDLE HEAT EXCHANGER

FIELD AND BACKGROUND OF THE INVENTION

The object of the present invention is a tube bundle heat exchanger, which includes a sealing system carried out on tubes made of silicon carbide and/or other non-solderable materials.

As everybody knows, different tube bundle heat exchangers are available on the market, which make use of heat exchange tubes made of silicon carbide or other non-solderable or hardly solderable materials. In particular the heat exchangers define at least a main chamber, which is crossed by the tube bundle, and at least a secondary chamber, which is in fluid connection with the inside of the tubes and is fluid proof with respect to the main chamber.

The heat exchange takes generally place in the inside of the main chamber, where a first fluid comes in touch with the outer surface of the tubes, which contain in turn the second fluid, with which the heat has to be changed.

As it clearly appears, among the main problems linked to the manufacture of heat exchangers there is the one of preventing, in an absolutely reliable manner, any blow-by or mixing between the fluid contained in the main chamber and the fluid contained in the tubes and in the secondary chamber.

The use of metal tubes solderable with tube plates, which are equally made of metal, ensures the maximum sealing between the two chambers; however, in more critical fields and particularly in the chemical field, in which very aggressive or corrosive compounds are employed, the use of such kind of metal materials is unadvisable.

In particular, in the last years tubes made of silicon carbide have spread out, which allow an optimum heat exchange together with a contemporary resistance to chemical agents, erosion and pressures; such tubes are just fitting for the above briefly outlined kind of employment.

Obviously this kind of tubes is not solderable with the respective tube plate and therefore problems arise in assuring the seal against fluid flow-by in the heat exchanger.

In particular a special embodiment, according to German patent n.DE 19714423, of the sealing means used in the above mentioned heat exchangers provides for the use of a flanged skirt, to the ends of which tube plates, which hold the tubes of silicon carbide, are firmly joined.

In addition to the said main plate use of a secondary plate, or counter-plate, is provider for, which plate has a diameter smaller than that of the main plate, and which is put in touch with the latter, in its face inside the skirt.

The silicon carbide tubes cross particularly both the main plate and the secondary plate.

In order to ensure the seal the use of an o-ring for each end of each tube is provided for; such o-ring is entrapped inside a seat, which is defined between the main plate and the secondary plate.

In particular the tightening of these two plates by means of screws implies squashing of the o-ring and tightness thereof.

Obviously also a gasket between the main plate and the skirt is provided for, in order to avoid flow-by between these two elements.

Although the above briefly outlined heat exchangers substantially ensure the fluid seal, they appear to be improvable under different points of view and manufacture parameters.

In other words, this kind of devices has not solved some problems and anyhow shows some operation lacks. First of all, the manufacture operations of the main and secondary plates imply special material removal processing, in order to define the semi seats which will have to house the various sealing o-rings.

It appears clearly that such processing has to be performed most accurately both on the one plate and on the respective counter-plate, in order to avoid possible flow-by during the work of the heat exchanger.

On the other side, only a single o-ring can be arranged at each end of the tube and this o-ring is burdened with the whole task of the sealing.

It appears therefore clear that such o-ring has to show resistance both to chemical agents and to temperature and pressures which take place in a heat exchanger and that a wrong positioning, or a wrong selection of materials, irremediably implies fluid flow-by.

Furthermore the locating of a counter-plate inside the main chamber lowers in a noticeable manner the heat exchange surfaces and reduces the effectiveness of the heat exchanger.

Last but not least, such kind of heat exchangers does not provide for any leak checking or alarm system. The technical task of the present invention is therefore to provide a heat exchanger which substantially eliminates all the above outlined operating lacks.

SUMMERY OF THE INVENTION

A first task of the invention is to provide a seal system for tube bundle heat exchangers, equipped with tubes of silicon carbide or of any non-solderable materials, which allows to avoid the above mentioned complex mechanical processing.

A further task of the invention is to provide a seal system which is extremely reliable and is furthermore capable of resisting to high operation pressures (even over 15 atmospheres).

Another task of the invention is to optimize the positioning of the sealing gaskets and their relating material in view of the chemical process, which takes place inside the tubes or inside the main chamber, and consequently of the relating chemical agents. A further task of the invention is to allow a tightening by use of three or more plates, without anyhow reducing the exchange surfaces inside the main chamber.

These tasks and the other ones, which will more clearly appear from the following description, are substantially reached with a heat exchanger in accordance to the attached claims.

BRIEF DESCRIPTION OF THE DRAWINGS

Further features and advantages will be more clear thanks to the detailed description of a preferred, but not exclusive embodiment of a heat exchanger according to the present invention.

Such description is performed hereinafter with reference to the attached exemplifying drawing tables, in which.

DESCRIPTION OF THE PREFERRED EMBODIMENTS

With reference to the said figures, with 1 is denoted as a whole a heat exchanger according to the invention, of the type which at present has the commercial name "FLOWSIC™".

As already pointed out, the core of the invention consists in the sealing system carried out on tubes of silicon carbide and/other of other non-solderable materials, which are utilized for manufacturing tube bundle heat exchangers.

Figure 1:
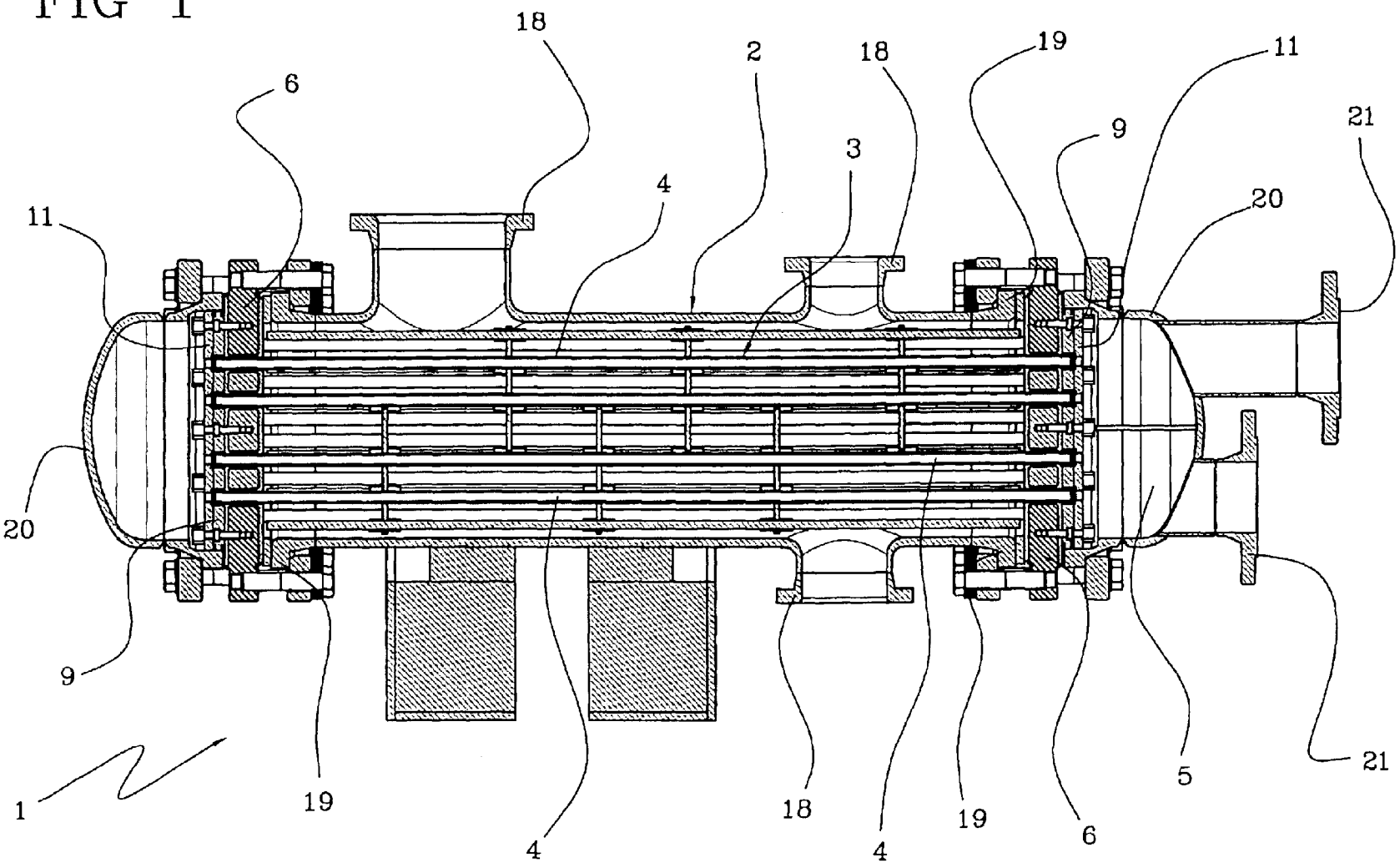
FIG. 1 shows a section view of the heat exchanger in accordance with the invention.

As shown in FIG. 1, the heat exchanger is formed by a bearing structure 2 comprising particularly a cylindrical flange skirt, which is adequate to delimit at least a main chamber 3, provided with fitting side inlets 18 for the fluid that has to circulate therein.

In correspondence to the flanged ends 19 of the skirt two respective tube plates 6 are provided for, which are adapted to hold a predetermined number of tubes 4 crossing the main chamber 3.

The tubes 4 are generally made of silicon carbide (but they could also be made of other non-solderable materials, on condition that they are suitable for heat exchange and resistance to chemical agents, temperatures and operation pressures).

Outside the tube plates 6 respective caps 20 can then be seen, which are fixed with hermetic sealing to the heat exchanger.

In particular a tightening system is provided, which packs the skirt flange 19, the tube plate 6 and the cap 20 one to each other, in a manner that is well known and can be seen in the attached figures.

To notice in at least one of the two caps 20 are inlets ad outlets 21 for letting the right fluid into a secondary chamber 5 and consequently the inside of the various tubes 4.

From a general point of view concerning the functioning, the heat exchange takes place inside the main chamber 3 thanks to the touch surfaces, defined by tubes 4, between the two fluids.

In other words, the fluid entering into the secondary chamber 5 will be brought into circulation inside the tubes 4 and therefore, once the heat exchange has taken place, it will flow out of the same secondary chamber 5.

The further fluid will be let in through the skirt side inlets 18 and it will circulate only inside the main chamber 3, directly in touch with the tubes 4.

Obviously no fluid flow between the main chamber 3 and the secondary chamber 5 shall occur, in order to avoid the process fluid to come into touch with the cooling fluid.

Evidently the process can take place both on the skirt side or on the tube side according to the requirements of the plant.

All this generally stated in advance (and today well known) relating to the heat exchangers on the market, we will hereinafter examine the special sealing system carried out on tubes 4 of silicon carbide.

Figure 2:
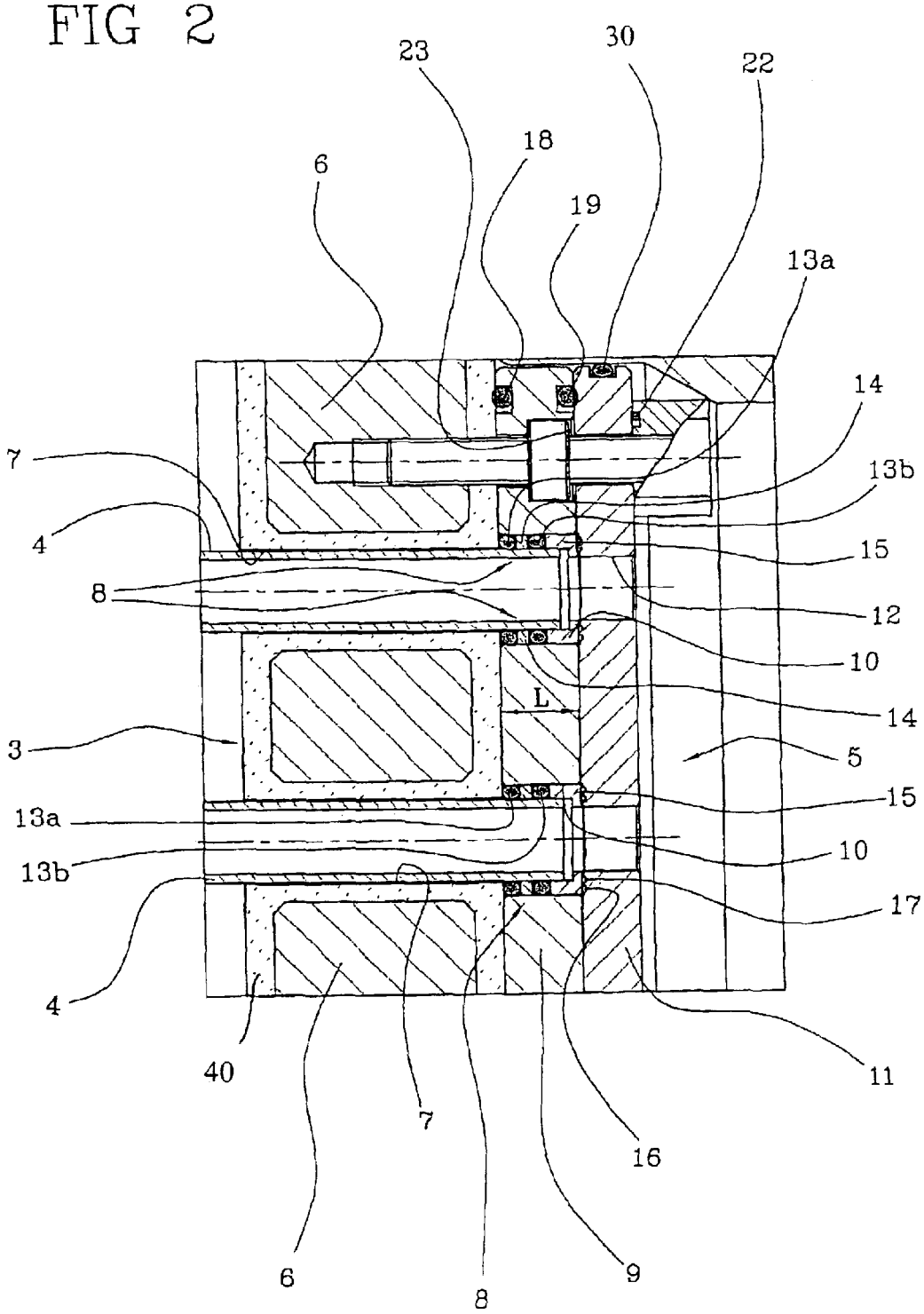
FIG. 2 shows an enlarged detail of the sealing means as shown in FIG. 1.

Looking particularly at the section view of FIG. 2, we see in the first place the tube plate 6, which shows the adequate through seats 7, which have to house in crossover manner the ends of the tubes 4.

By way of example the tube plate 6 can be made of stainless steel (e.g. AISI 304L) and it is generally coated with PFA (40), so that it can resist to the chemical attacks.

The tube plate 6 shows generally an outer diameter substantially equal or longer than the diameter of the skirt flanges and it is provided with a double hole for its independent fastening to the skirt flanges.

Outside the tube plate 6 and on the side opposed to the skirt face we can further see a containing plate 9, which—by way of example—is made of stainless steel (AISI 316L), or of PTFE/25% glass, or of noble materials, and which shows respective holding seats 10, one for each tube.

The holding seats 10 are circular coaxial seats with a diameter longer than the outer diameter of the tubes 4.

Such holding seats 10 are adapted to house both the end portions of the tubes 4 of silicon carbide and the adequate sealing means B, which have to prevent fluid flow-by between the main chamber 3 and the secondary chambers 5.

Always according to the figures, the sealing means 8 comprise at least a first and a second sealing element 13*a*, 13*b* for each tube 4.

In particular such sealing means are defined by respective rubber o-rings (KALREZ®+VITON®), or by corresponding materials, which resist to corrosion and temperature.

Such o-rings surround the end portions of the tubes 4 and can advantageously be made of the most adequate materials.

In particular, if the chemical process is carried out on the skin side (chamber 3), the first o-ring will be of the KALREZ type, while the second o-ring could be of VITON type.

Vice versa, should the process take place on the side facing the tubes (chamber 5 + inside of the tubes) and the cooling on the skirt side, the axial position of the two o-rings could conveniently be inverted, so that the firs o-ring 13 would be of the VITON type and the second o-ring 13*b* of the KALREZ type.

It is further to point out that the sealing means 8 also comprise a spacing register bush 14, which is axially interposed between the two o-rings, and further a bush pressing element 15, which is equally arranged around an end of the tube and acts on the second sealing element 13*b*.

The spacing bush 14 may be made of PTFE/25% glass and/or of another antacid material; the bush pressing element 15 may be made of virgin PTFE or of another antacid material.

The bush pressing element 15 has a section shaped as a double L upside-down (see FIG. 2), so that an axial extraction of the tubes is avoided in the case a vacuum should occur.

It must also be pointed out that the bush pressing element 15 is provided with a face 16 facing to and abutting on a further clamping plate 11, which shows a predetermined number of sealing riflings 17 fit for functions which will be better explained hereinafter.

It is further to point out that each holding seat 10 is delimited in radial direction by the containing plate 9 (externally) and by the outer surface of the tube 4 (internally). Also the holding seat 10 is axially delimited, on the one side, by the tube plate 6 and, on the other side, by the clamping plate 11.

It is particularly to point out that under assembly conditions the containing plate 9 has only the function of delimiting the holding seat 10 and exerts no pressing action on the o-rings or on the bushes.

Figure 3:
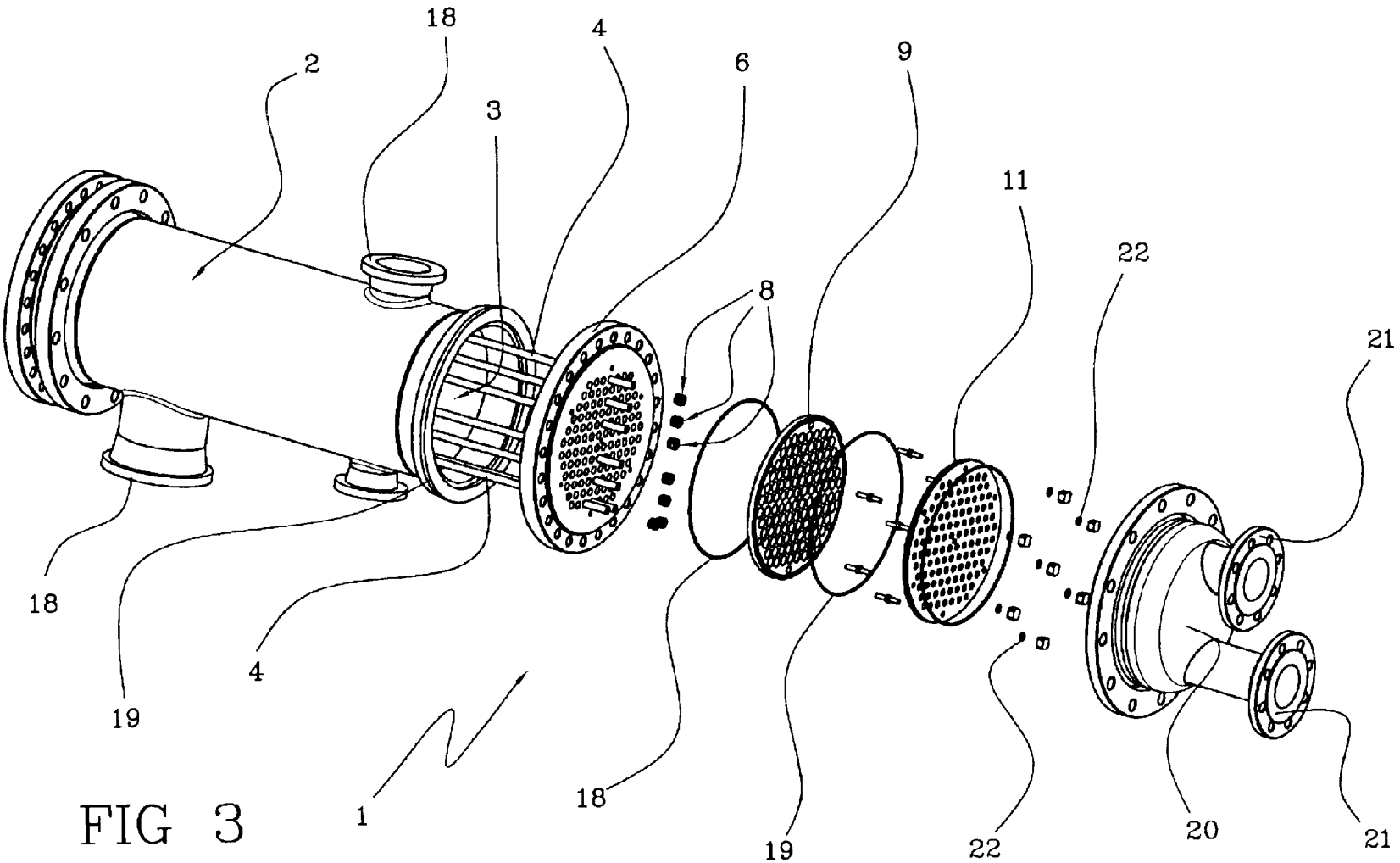
FIG. 3 shows an exploded view of the heat exchanger as shown in FIG. 1.

Always with reference to FIG. 3, a clamping plate 11 can be seen, which is in touch with the above described containing plate 9, always from the exterior of the skirt side.

Also the clamping plate shows the adequate through seats 12, in order to put the inside of the tubes 4 in fluid connection with the secondary chambers 5.

Other sealing gaskets 18, 19, in the form of outer o-rings, are provided for to ensure sealing between the tube plate 6 and the containing plate 9, as well as between the containing plate 9 and the clamping plate 11.

The seats for such o-rings consist generally in adequate opposing hollows, which are obtained outside the faces of the containing plate 9.

During the assembling phases the various tubes are inserted into the tube plate 6 and the containing plate 9 is then clamped against the tube plate 6 itself, by means of the adequate double threaded screws (upon positioning of the sealing gasket 18).

The double threaded screws may be made e.g. of AISI 316L steel, or of other noble materials. The sealing gaskets 13*a*, 13*b*, as well as the various spacing register bushes 14 and the bush pressing elements 15 and also the sealing gasket 19 are now positioned.

Then the subsequent engagement of the clamping plate 11 is carried out by means of adequate nuts (generally blind plugs), which engage in the thread of the abovementioned screw.

Obviously, in order to avoid fluid flow-by towards the threads of such screws, adequate o-rings 22 are provided for on the tightening nuts, as well as flat sealing gaskets 23, between the clamping plate 11 and the containing plate 9, just in correspondence to the screws.

Obviously the clamping effect carried out by the above mentioned nuts causes an axial thrust action to be transmitted to the bush pressing element 15, to the sealing gasket 13*a*, 13*b* and to the spacing bush 14, what causes deformation of o-rings and therefore the sealing of the system as a whole.

Obviously, in order to obtain all that, the axial length "L" of the seat has to be lightly smaller than the total axial length of the four above mentioned elements.

Furthermore the presence of the sealing riflings 17 on the bush pressing element improves the reliability of the system, since, in consequence of the clamping of the third plate 11, a force is produced between the plate 11 itself and the face 16 of the bush pressing element, so that the riflings 17 press on the plate 11 and prevent flow-by more and more.

It is finally to point out that in a modified embodiment of the above described sealing system it will be possible to provide for an adequate radial outer hollow, on the clamping plate 11, for the housing of a sealing o-ring.

As a matter of fact it possible in this way to provide for the addition of a check and alarm ring (e.g. made of PFA coated steel) with lateral threaded fittings, between the tube plate 6 and the heat exchanger head, for the inlet of a possible protection gas (nitrogen) and/or the connection to an alarm feeler, a display, or the like.

In such a case the sealing o-ring 30, which is inserted in the outer radial hollow, will allow sealing on the inner diameter of the check ring. Obviously, in the case of this change the internal sealing o-ring 19 will be removed and it will be possible to ascertain the possible fluid flow-by between the clamping plate 11 and the containing plate 9, or even exert the above mentioned overpressure, by means of a neutral gas as nitrogen.

The invention ensures remarkable advantages. First of all the sealing system carried out by the present invention allows to obtain all the housing seats for o-rings by way of simple processing. In particular the containing plate shows only cylindrical holes having a diameter bigger than the diameter of the tube to define the sealing seats.

Furthermore the presence of different o-rings allows better configuration of the heat exchanger, depending on whether the chemical process takes place on the skirt side or on the side facing to the tubes.

The possibility of adding a further check/alarm ring, upon costumer's demand, makes moreover the system fit even for processes requiring high security levels.

The presence of more different sealing elements has allowed getting over sealing laboratory tests over 16 atm for several minutes without flow-by.

What is claimed is:

1. Heat exchanger comprising:

a bearing structure (2), which defines at least a main chamber (3);

a predetermined number of tubes (4), which cross said main chamber (3):

at least a secondary chamber (5), which is in fluid connection with said tubes (4) and fluid proof with respect to the main chamber (3);

at least a tube plate (6), which shows the adequate seats (7) for housing said tubes (4), wherein said tube plate (6) is interposed between the main chamber (3) and the secondary chamber (5);

sealing means (8) interposed at least between the main chamber (3) and the seconday chamber (5) to avoid fluid flow-by, wherein it further comprises:

a containing plate (9), which shows a respective holding seat (10) for each tube (4), wherein said holding seat (10) is crossed by a tube (4) and houses the sealing means (8); and each holding seat (10) being delimited in radial direction by the containing plate (9), externally, and by the surface of the tube (4), internally, and the holding seat (10) being also axially delimited, on the one side, by the tube plate (6) and, on the other side, by the clampling plate (11).

The sealing means (8) comprising at least a first and a second sealing element (13*a*, 13*b*) for each tube (4), wherein said sealing elements (13*a*, 13*b*) surround the tube (4) and are housed in the holding seat (10) defined by the containing plate (9).

2. Heat exchanger according to claim 1, wherein the sealing means (8) comprise a spacing bush (14), which is arranged around the tube (4) and interposed between the sealing means (13*a*, 13*b*).

3. Heat exchanger according to claim 1, wherein the sealing means (8) comprise a bush pressing element (15) arranged around the tube (4) and acting on the second sealing means (13*b*).

4. Heat exchanger according to claim 3, wherein the bush pressing element (15) shows a face (16) facing to and abutting on the clamping plate (11), wherein said face shows a predetermined number of sealing riflings (17).

5. Heat exchanger according to claim 1, wherein the clamping plate (11) abuts on the containing plate (9).

6. Heat exchanger according to claim 1, wherein containing plate (9) abuts on the tube plate (6).

7. Heat exchanger according to claim 1, further comprising a sealing gasket (18), which is interposed between the containing plate (9) and the tube plate (6).

8. Heat exchanger according to claim 1, further comprising a sealing gasket (19), which is interposed between the clamping plate (11) and the containing plate (9).

9. Heat exchanger according to claim 1, wherein said clamping plate (11), in correspondence to an outer surface thereof, shows a seat (30) which is fit for housing an adequate gasket.

10. Heat exchanger according to claim 1, wherein a clamping packing of tube plate (6), containing plate (9) and clamping plate (11) implies deformation of at least the said sealing elements (13*a*, 13*b*), due to compression.

11. Heat exchanger comprising:

a bearing structure (2), which defines at least a main chamber (3);

a predetermined number of tubes (4), which cross said main chamber (3);

at least a secondary chamber (5), which is in fluid connection with said tubes (4) and fluid proof with respect to the main chamber (3);

at least a tube plate (6), which shows the adequate seats (7) for housing said tubes (4), wherein said tube plate (6) is interposed between the main chamber (3) and the secondary chamber (5);

sealing means (8) interposed at least between the main chamber (3) and the seconday chamber (5) to avoid fluid flow-by, wherein it further comprises:

a containing plate (9), which shows a respective holding seat (10) for each tube (4), wherein said holding seat (10) is crossed by a tube (4) and houses the sealing means (8), the sealing means (8) comprising at least a first and a second sealing element (13*a*, 13*b*) for each tube (4), wherein said sealing means (13*a*, 13*b*) surround the tube (4) and are housed in the holding seat (10) defined by the containing plate, the sealing means (8) further comprising a spacing bush (14), which is arranged around the tube (4) and interposed between the sealing means (13*a*, 13*b*); and a clamping plate (11), which equally shows respective through seats (12), in order to put the secondary chamber (5) in fluid connection with the tubes (4), wherein said containing plate (9) is interposed between the tube plate (6) and the clamping plate (11).

12. Heat exchanger according to claim 11, wherein each holding seat (10) is delimited in radial direction by the containing plate (9), externally, and by the surface of the tube (4), internally, and it is axially delimited, on the one side, by the tube plate (6) and, on the other side, by the clamping plate (11).

13. Heat exchanger comprising:

a bearing structure (2), which defines at least a main chamber (3);

a predetermined number of tubes (4), which cross said main chamber (3);

at least a secondary chamber (5), which is in fluid connection with said tubes (4) and fluid proof with respect to the main chamber (3);

at least a tube plate (6), which shows the adequate seats (7) for housing said tubes (4), wherein said tube plate (6) is interposed between the main chamber (3) and the secondary chamber (5);

sealing means (8) interposed at least between the main chamber (3) and the seconday chamber (5) to avoid fluid flow-by, wherein it further comprises:

a containing plate (9), which shows a respective holding seat (10) for each tube (4), wherein said holding seat (10) is crossed by a tube (4) and houses the sealing means (8), the sealing means (8) comprising at least a first and a second sealing element (13*a*, 13*b*) for each tube (4), wherein the said sealing elements (13*a*, 13*b*) surround the tube (4) and are housed in the holding seat (10) defined by the containing plate (9); and a clampling plate (11) which equally shows respective through seats (12) in order to put the secondary chamber (5) in fluid connection with the tubes (4), wherein said containing plate (9) is interposed between the tube plate (6) and the clampling plate (11), said clampling plate (11), in correspondence to an outer surface thereof, has a seat (30) which is fit for housing an adequate gasket, a clamping packing of tube plate (6), containing plate (9) and clamping plate (11) implies deformation of at least the said sealing elements (13*a*, 13*b*), due to compression.

* * * * *